US009669452B2

(12) United States Patent
Wi

(10) Patent No.: US 9,669,452 B2
(45) Date of Patent: Jun. 6, 2017

(54) PRE-HEMMING APPARATUS

(71) Applicant: Hyundai Motor Company, Seoul (KR)

(72) Inventor: Kyung Chan Wi, Ulsan (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 14/950,817

(22) Filed: Nov. 24, 2015

(65) Prior Publication Data

US 2017/0014893 A1 Jan. 19, 2017

(30) Foreign Application Priority Data

Jul. 13, 2015 (KR) ..... 10-2015-0099262

(51) Int. Cl.
*B21D 39/02* (2006.01)

(52) U.S. Cl.
CPC ..... *B21D 39/021* (2013.01)

(58) Field of Classification Search
CPC ..... B21D 39/02; B21D 39/021; B21D 19/043
See application file for complete search history.

(56) References Cited

U.S. PATENT DOCUMENTS 4,928,388 A * 5/1990 Dacey, Jr. ..... B21D 39/021 29/21.1
5,038,597 A * 8/1991 Dorsett ..... B21D 5/16 100/271
5,272,903 A * 12/1993 Evans ..... B21D 39/021 100/271
6,324,880 B1 * 12/2001 Nakamura ..... B21D 39/021 29/243.58
2002/0185522 A1 * 12/2002 Palladino ..... B21D 39/02 228/212
2013/0091699 A1 * 4/2013 Kim ..... B25J 9/0084 29/822

FOREIGN PATENT DOCUMENTS

| | | | |
|---|---|---|---|
| EP | 0 406 301 | B1 | 9/1992 |
| JP | 1996-197149 | | 8/1996 |
| KR | 10-2005-0120272 | A | 12/2005 |
| KR | 10-2006-0007829 | | 1/2006 |
| KR | 10-0604204 | B1 | 7/2006 |
| KR | 10-1100294 | | 12/2011 |

* cited by examiner

*Primary Examiner* — Debra Sullivan

(74) *Attorney, Agent, or Firm* — Brinks Gilson & Lione

(57) ABSTRACT

The present disclosure provides a pre-hemming apparatus including: an actuator which is coupled to one side of a main body; a pre-hemming body which is positioned at the other side of the main body and has a pre-hemming punch; and a driving link which connects the actuator with the pre-hemming body at the main body, has a plurality of link members that are operated by the actuator, and transmits force for pre-hemming a subject to the pre-hemming body when the plurality of link members are operated.

9 Claims, 5 Drawing Sheets

PRE-HEMMING APPARATUS

CROSS-REFERENCE TO RELATED APPLICATION

This application claims the benefit of Korean Patent Application No. 10-2015-0099262 filed on Jul. 13, 2015, the entirety of which is hereby incorporated herein by reference.

FIELD

The present disclosure relates to a pre-hemming apparatus.

BACKGROUND

The statements in this section merely provide background information related to the present disclosure and may not constitute prior art.

In general, for a vehicle to be manufactured, about twenty thousand to thirty thousand components go through assembly processes.

In some instances, a vehicle body is produced at a first step of a process of manufacturing a vehicle. Product panels are produced by various types of press apparatuses, and the product panels are conveyed to a vehicle body factory, and a vehicle body in a white body (B.I.W.) state is made by assembling respective parts of the product panel.

In order to form the panel as described above, a forming process of pressing and forming the panel into a predetermined shape using various types of press apparatuses is carried out, and thereafter, processing work such as cutting, hole processing, bending, and warping is carried out during a press process such as trimming, piercing, flanging, and hemming.

Generally, the hemming process is carried out by pre-hemming work through an elliptical trajectory motion of a pre-hemming punch, and thereafter, completing the hemming process through a vertical motion of the hemming punch.

FIG. 1 illustrates a pre-hemming apparatus 10 in the related art. A pre-hemming punch 40 is positioned on a panel primarily by a latch cylinder 20 of two high capacity cylinders, and secondarily, the pre-hemming punch 40 transmits horizontally force by a hemming cylinder 30, and finally, hemming work is carried out for the panel.

However, two cylinders 20 and 30 are installed in the pre-hemming apparatus such that manufacturing costs become high, and the two cylinders 20 and 30 are simultaneously operated when the hemming work is carried out for the panel, such that time required to process the panel is increased.

SUMMARY

The present disclosure provides a pre-hemming apparatus capable of minimizing the number of cylinders for operating a pre-hemming punch by applying a link system, thereby reducing costs required to manufacture the apparatus and reducing time required to process a panel.

One aspect of the present disclosure provides a pre-hemming apparatus including: an actuator which is coupled to one side of a main body; a pre-hemming body which is positioned at the other side of the main body and has a pre-hemming punch; and a driving link which connects the actuator with the pre-hemming body at the main body, has a plurality of link members that are operated by the actuator, and transmits force for pre-hemming a subject to the pre-hemming body when the plurality of link members are operated.

In one form, the driving link may include: a first link member which has one side hingedly coupled to a first hinge point formed at a coupling member of the main body, and the other side that is connected with the actuator so that the first link member rotates by an operation of the actuator; a second link member which is hingedly coupled to a second hinge point formed at a position that forms an acute angle with the first hinge point at the coupling member; and a third link member which is hingedly coupled to the second link member, and connected to a third hinge point formed at the first link member.

In another form, the second link member may connect the pre-hemming body with the main body, and transmit horizontal pressing force to the pre-hemming body by receiving rotational force that is generated when the first link member and the third link member are sequentially rotated.

In still another form, the actuator may be a cylinder mechanism which has a piston that is connected to the first link member and operates the first link member.

In yet another form, the actuator may include: a cylinder which is coupled to the main body; and a piston rod which connects the cylinder with the first link member, and rotates the first link member by moving forward and rearward in a vertical direction.

In a further form, the cylinder may be installed at a rear side of the main body while having an inclination.

In another further form, the cylinder may be hingedly coupled at a rear side of the main body, such that an installation inclination of the cylinder is changed when the piston rod is operated.

In still another further form, the first link member may be bent in a '⌉' shape, and vertically positioned with respect to the main body when the first link member is rotated by an operation of the actuator.

In yet another further form, the pre-hemming body may be positioned at the other side of the main body at a position higher than a coupled position of the actuator coupled to one side of the main body.

In still yet another further form, a position of the pre-hemming punch may be finely adjustable in three directions on the pre-hemming body.

In a still further form, the pre-hemming punch may be coupled to be separable from the pre-hemming body.

In a yet still further form, the pre-hemming apparatus may further include a stopper which is installed to protrude downward from the pre-hemming body, and positioned to be caught by the main body to restrict a rotation range of the pre-hemming body.

The present disclosure minimizes the number of cylinders for operating the pre-hemming punch by applying the link system, thereby reducing costs required to manufacture the apparatus and reducing time required to perform the process of hemming the panel.

The present disclosure may decrease an overall height of the apparatus by reducing the number of cylinders, and as a result, it is possible to reduce sway of the cylinder during the operation, thereby improving quality at the time of processing the panel.

It is understood that the term "vehicle" or "vehicular" or other similar terms as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles, e.g., fuel derived from resources other than petroleum. As referred to herein, a hybrid vehicle is a vehicle that has two or more sources of power, for example, both gasoline-powered and electric-powered vehicles.

Further areas of applicability will become apparent form the description provided herein. It should be understood that the description and specific examples are intended for purposes of illustration only and are not intended to limit the scope of the present disclosure.

BRIEF DESCRIPTION OF THE DRAWINGS

In order that the disclosure may be well understood, there will now be described various forms thereof, given by way of example, reference being made to the accompanying drawings, in which.

Figure 1:
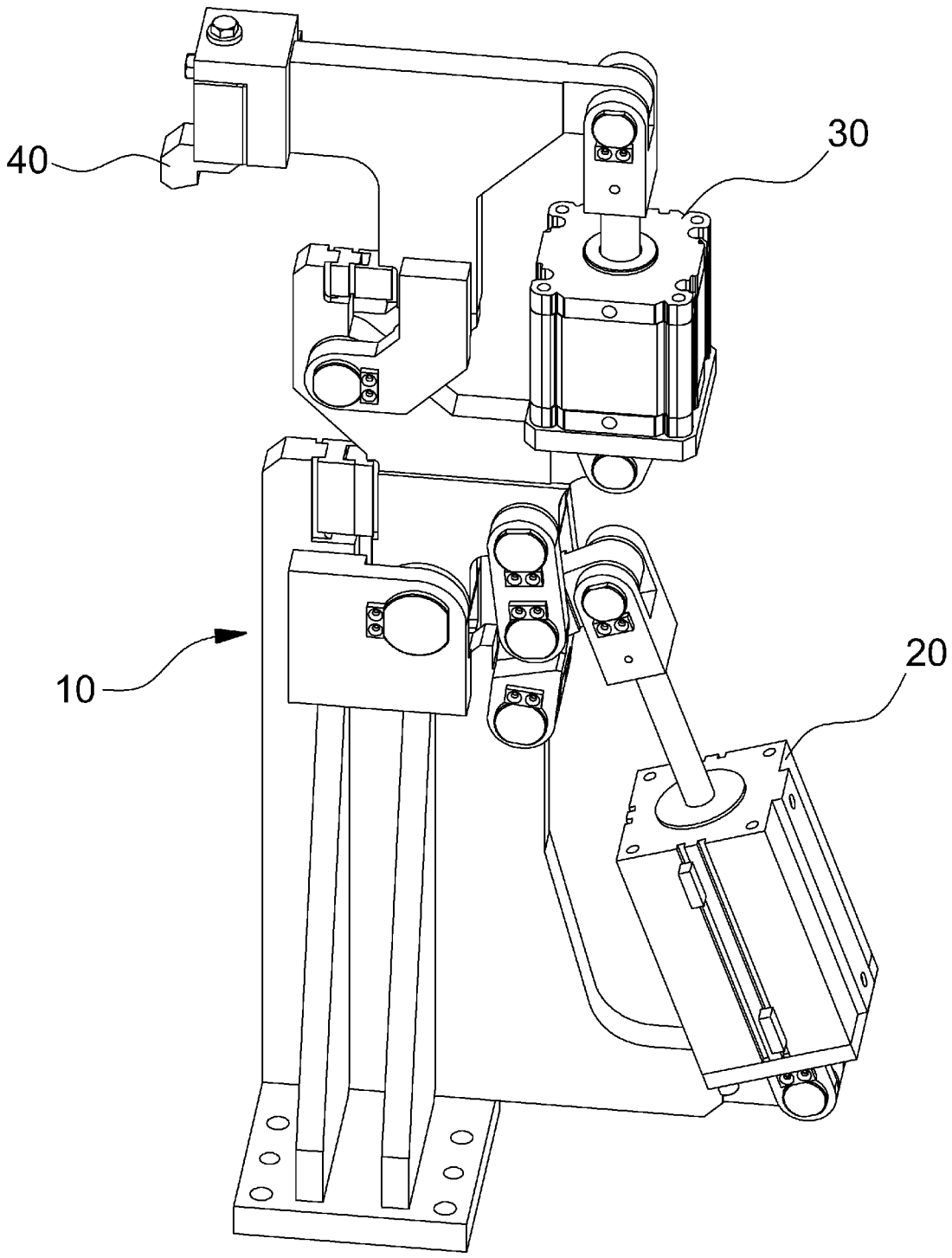
FIG. 1 (Prior art)
FIG. 1 is a diagram illustrating an existing pre-hemming apparatus in the related art.

Reference numerals set forth in the Drawings include reference to the following elements as further discussed below:

1: main body
2: coupling member
100: actuator
110: cylinder
120: piston rod
122: transmission member
124: connecting member
200: pre-hemming body
210: pre-hemming punch
212: bolt
300: first link member
400: second link member
500: third link member
600: stopper
P1: first hinge point
P2: second hinge point
P3: third hinge point It should be understood that the appended drawings are not necessarily to scale, presenting a somewhat simplified representation of various preferred features illustrative of the basic principles of the disclosure. The specific design features of the present disclosure as disclosed herein, including, for example, specific dimensions, orientations, locations, and shapes will be determined in part by the particular intended application and use environment.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

Figure 2:
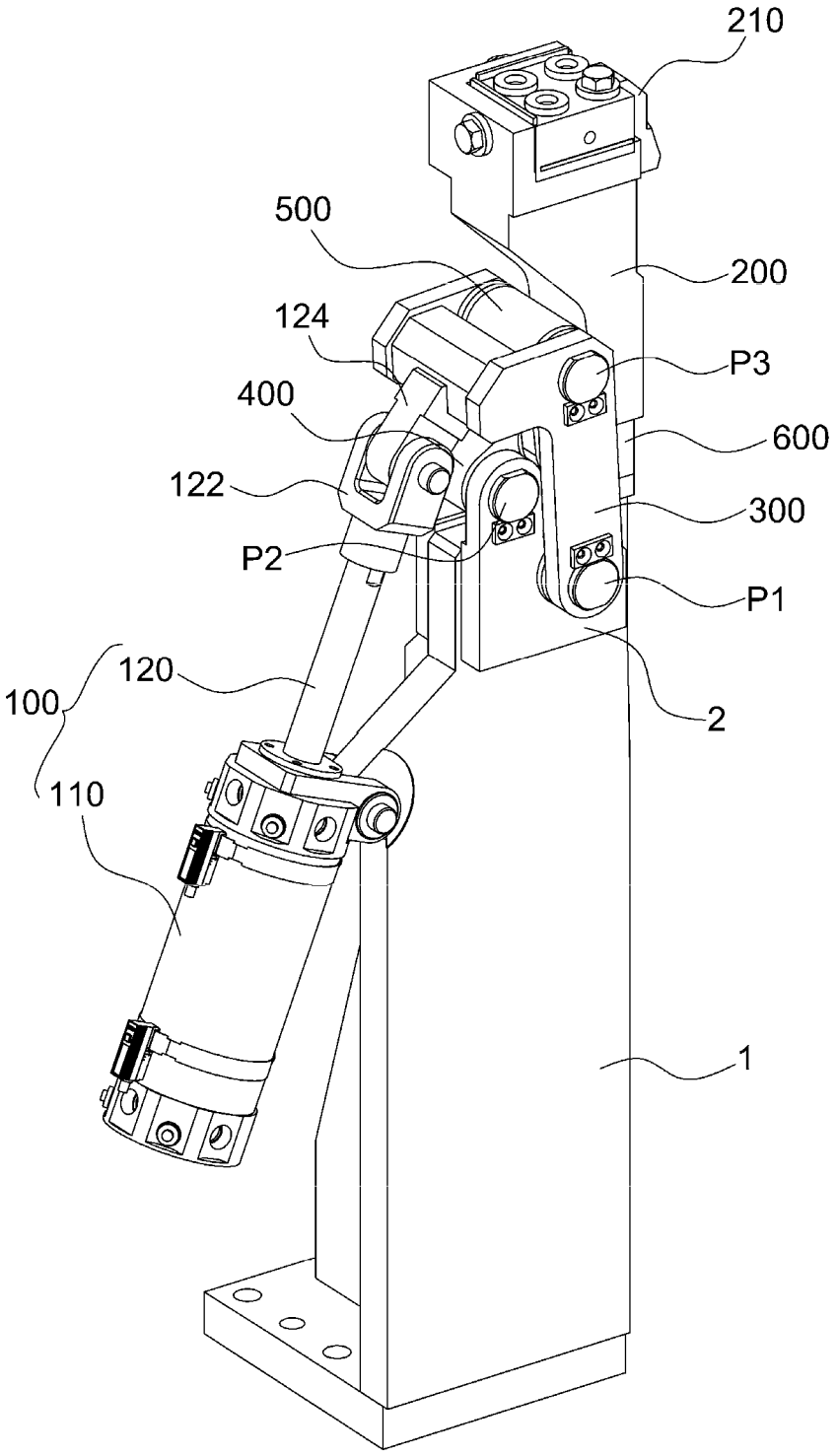
FIG. 2 is a diagram illustrating a pre-hemming apparatus according to an exemplary form of the present disclosure.
Figure 3:
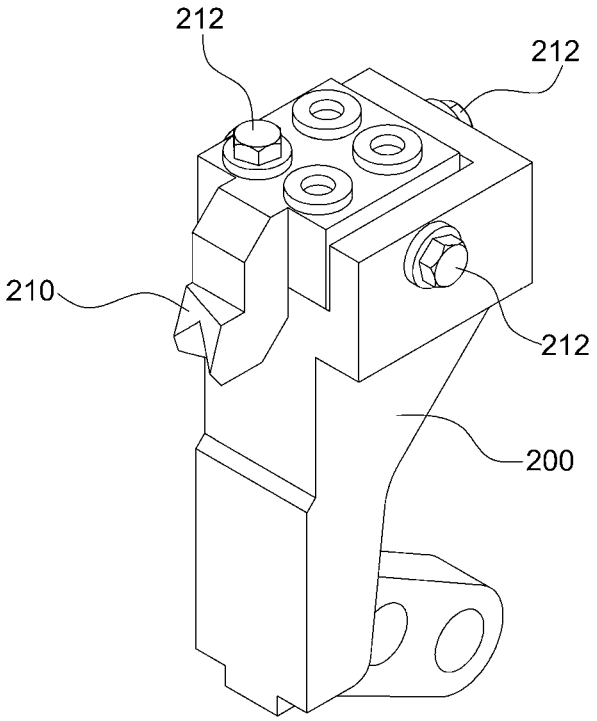
FIG. 3 is a diagram illustrating a pre-hemming punch of the pre-hemming apparatus according to the exemplary form of the present disclosure.

The present disclosure relates to a pre-hemming apparatus FIG. 2 illustrates a pre-hemming apparatus according to an exemplary form of the present disclosure, and FIG. 3 illustrates a pre-hemming punch of the pre-hemming apparatus according to the exemplary form of the present disclosure.

As illustrated in FIG. 2, a pre-hemming apparatus includes an actuator 100, a pre-hemming body 200, and link members. Here, the link members are formed by coupling a first link member 300, a second link member 400, and a third link member 500.

First, the actuator 100 is hingedly coupled at a rear side of a main body 1 and moves forward and rearward in a vertical direction so that force, which is generated when the actuator 100 moves forward and rearward in the vertical direction, may be easily transmitted to the first link member 300.

The actuator 100 is positioned at a rear side of the main body 1 at a position lower than the pre-hemming body 200 installed at a front side of the main body 1, and pushes the pre-hemming body 200 upward.

The actuator 100 may be configured by a hydraulic cylinder, and includes a cylinder 110 which is hingedly coupled at the rear side of the main body 1, and a piston rod 120 which is coupled to the cylinder 110, operated by hydraulic pressure, and connected with a connecting member 124 of the first link member 300 by means of a transmission member 122 coupled to one end of the piston rod 120.

The pre-hemming body 200 is coupled at the front side of the main body 1, and has a pre-hemming punch 210 that protrudes forward.

As illustrated in FIG. 3, the pre-hemming punch 210 is installed to directly press a panel, and coupled to protrude from the pre-hemming body 200, and a position of the pre-hemming punch 210 may be finely adjusted in three directions, a left and right direction, an up and down direction, and a forward and rearward direction, by adjusting a bolt 212 or a shim.

The pre-hemming punch 210 may be selectively separated from the pre-hemming body 200 by removing the bolt 212 or the shim, whereby the pre-hemming punch 210 may be easily replaced from the pre-hemming body 200 when the pre-hemming punch 210 is damaged.

Referring again to FIG. 2, one side of the first link member 300 is hingedly coupled to a first hinge point P1 formed at a coupling member 2 of the main body 1, and the other side is connected with the actuator 100, such that the first link member 300 rotates along with an operation of the actuator 100.

The second link member 400 connects the pre-hemming body 200 with the main body 1, and is hingedly coupled to a second hinge point P2 formed at a position that forms an acute angle with the first hinge point P1 in the coupling member 2.

The third link member 500 is hingedly coupled to the second link member 400, and connected to the third hinge point P3 formed on the first link member 300.

The second link member 400 according to the present form transmits horizontal pressing force to the pre-hemming body 200 by receiving rotational force that is generated when the first link member 300 and the third link member 500 rotate sequentially when the actuator 100 is operated.

Figure 4:
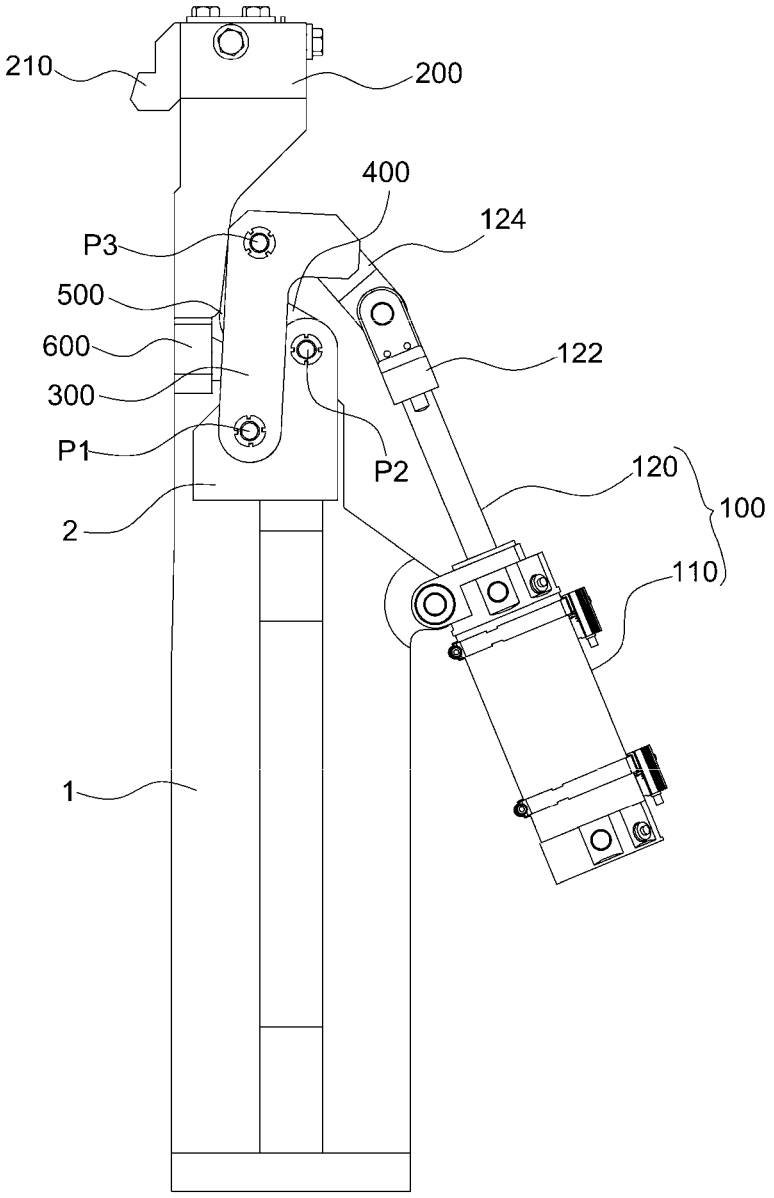
FIG. 4 is a diagram illustrating a hemming operating state of the pre-hemming apparatus according to the exemplary form of the present disclosure.
Figure 5:
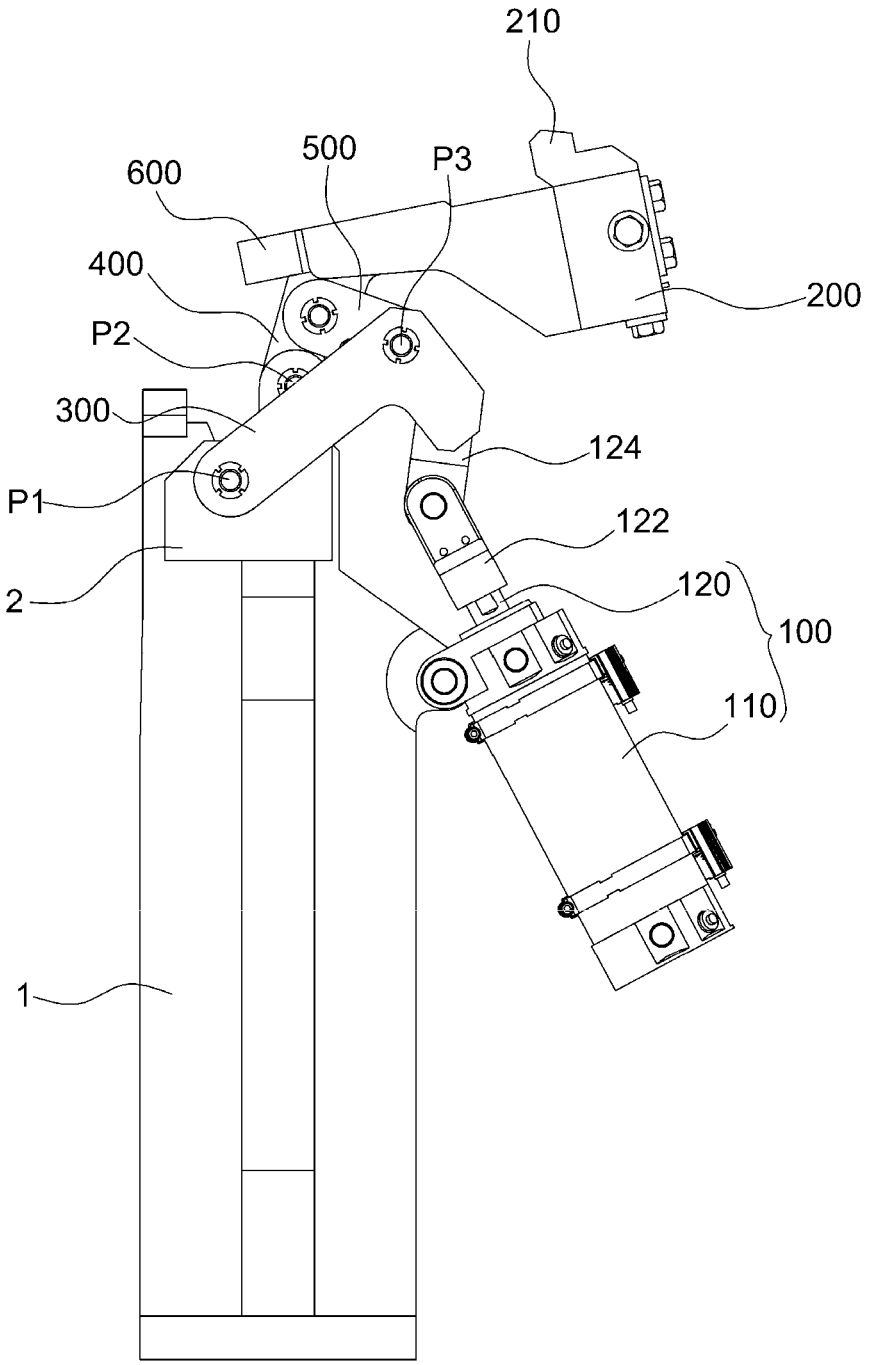
FIG. 5 is a diagram illustrating an operation of the pre-hemming apparatus according to the exemplary form of the present disclosure.

Referring now to FIGS. 4 and 5, an operation of the pre-hemming apparatus including the aforementioned constituent elements will now be described.

A stopper 600 is vertically installed so as to protrude downwards from the pre-hemming body 200, and when the pre-hemming body 200 rotates to a hemming position, the stopper 600 is caught by the main body 1 to restrict a rotation range of the pre-hemming body 200.

Meanwhile, in the present form, when the actuator 100 is operated, the pre-hemming body 200 moves in a horizontal direction by means of a link system including the first link member 300, the second link member 400, and the third link member 500, and performs a process of hemming the panel, thereby reducing costs and processing time required to manufacture the apparatus.

That is, as illustrated in FIG. 1, a pre-hemming apparatus 10 in the related art is provided with two cylinders 20 and 30, and when the cylinder 20 positioned at a lower side is operated so that the pre-hemming punch 40 is positioned adjacent to the panel, the cylinder 30 positioned at an upper side is operated to move forward the pre-hemming punch 40 in the horizontal direction, thereby performing a process of hemming the panel.

However, since the two cylinders 20 and 30 are required for the pre-hemming apparatus 10 in the related art, a multi-stage structure is required to fix and operate the two cylinders 20 and 30, which causes manufacturing costs of the apparatus to become high.

Since the multi-stage structure is required for the pre-hemming apparatus 10 in the related art in order to install the two cylinders 20 and 30, a height of the apparatus relatively increases, which causes the pre-hemming punch 40 to be swayed when the hemming operation is carried out.

Therefore, with only the operation of the single actuator 100, the pre-hemming apparatus according to the present form may perform the same operation as the pre-hemming apparatus 10 in the related art which is provided with the two cylinders 20 and 30, such that it is possible to reduce the number of components, a weight and a height accordingly, thereby reducing costs and the number of processes required for the manufacture described above.

In comparison with the pre-hemming apparatus 10 in the related art, in the present embodiment, the first link member 300, the second link member 400, and the third link member 500 may be operated by a lifting operation by the single actuator 100 without using sequential operations of the two cylinders 20 and 30, thereby improving convenience during the hemming process.

Hereinafter, FIG. 4 illustrates a hemming operating state of the pre-hemming apparatus according to one form of the present disclosure, and FIG. 5 illustrates an operation of the pre-hemming apparatus according to the present form of the present disclosure.

An operation of the pre-hemming apparatus will be sequentially described below with reference to FIGS. 4 and 5.

First, the piston rod 120 is operated in the cylinder 110 to push upward the transmission member 122 coupled to one end of the piston rod 120.

The cylinder 110 is hingedly coupled while having an inclination to form an acute angle with one surface of the main body 1, and rotated with respect to the main body 1 by an operation of the piston rod 120 so that a coupling position thereof may be changed, and as a result, the piston rod 120 is operated in a direction in which the transmission member 122 is pushed upward, thereby facilitating the rotational movement of the first link member 300.

The first link member 300 is bent in a '⌉' shape, and a bent cross section is connected with the piston rod 120 that is moved upward and downward, thereby effectively transmitting rotational force caused by the upward and downward movement of the piston rod 120 to the second link member 400 and the third link member 400.

The reason is that if the first link member 300 is formed in an 'I' shape, a connection portion with the piston rod 120 needs to be lengthened, and as a result, force caused by the upward and downward movement of the piston rod 120 cannot be effectively transmitted to the first link member 300.

Meanwhile, as the piston rod 120 is operated, the first link member 300, which is connected with the transmission member 122 by means of the connecting member 124, is rotated by using the first hinge point P1 as an axis, and in this case, the third link member 500 is rotated by using the third hinge point P3 as an axis, in a direction identical to the rotation direction of the first link member 300.

Here, the third link member 500 pushes and rotates the second link member 400, and the second link member 400 moves the pre-hemming body 200 to the hemming position while rotating by using the second hinge point P2 as an axis.

In this case, the second link member 400 transmits rotational force, which is transmitted as the first link member 300 and the third link member 500 are sequentially rotated, to the pre-hemming body 200, thereby allowing the pre-hemming punch 210 to perform the process of pre-hemming the panel that is a subject, by using strong horizontal pressing force.

Consequently, the pre-hemming apparatus according to the present form may transmit horizontal pressing force to the pre-hemming body 200 when the actuator 100 is operated, through the link system according to the sequential rotation of the first link member 300, the third link member 500, and the second link member 400, thereby easily performing the process of hemming the panel only by using the single actuator 100.

The present disclosure minimizes the number of cylinders for operating the pre-hemming punch by applying the link system, thereby reducing costs required to manufacture the apparatus and reducing time required to perform the process of hemming the panel.

The present disclosure may decrease an overall height of the apparatus by reducing the number of cylinders, and as a result, it is possible to reduce sway of the cylinder during the operation, thereby improving quality at the time of processing the panel.

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. A pre-hemming apparatus comprising:

an actuator which is coupled to a first side of a main body;

a pre-hemming body which is positioned at a second side of the main body and has a pre-hemming punch; and a driving link which connects the actuator with the pre-hemming body at the main body, has a plurality of link members that are operated by the actuator, and transmits force for pre-hemming a subject to the pre-hemming body when the plurality of link members are operated, wherein the driving link includes, a first link member which has a first end hingedly coupled to a coupling member of the main body at a first hinge point, and a second end that is connected with the actuator so that the first link member rotates by an operation of the actuator;

a second link member which is hingedly coupled at a position that forms an acute angle with the first hinge point at the coupling member at a second hinge point; and a third link member which is hingedly coupled to the second link member, and connected to the first link member at a third hinge point;

wherein the second link member connects the pre-hemming body with the main body, and transmits horizontal pressing force to the pre-hemming body by receiving rotational force that is generated when the first link member and the third link member are sequentially rotated; and wherein the first link member is L-shaped, and vertically positioned with respect to the main body when the first link member is rotated by an operation of the actuator.

2. The pre-hemming apparatus of claim 1, wherein the actuator is a cylinder mechanism which has a piston that is connected to the first link member and operates the first link member.

3. The pre-hemming apparatus of claim 2, wherein the actuator includes:

a cylinder which is coupled to the main body; and a piston rod which connects the piston with the first link member, and rotates the first link member by moving forward and rearward in a vertical direction.

4. The pre-hemming apparatus of claim 3, wherein the cylinder is installed at a rear side of the main body while having an inclination.

5. The pre-hemming apparatus of claim 4, wherein the cylinder is hingedly coupled at the rear side of the main body, such that an installation inclination of the cylinder is changed when the piston rod is operated.

6. The pre-hemming apparatus of claim 1, wherein the pre-hemming body is positioned at the second side of the main body at a position higher than a coupled position of the actuator coupled to first side of the main body.

7. The pre-hemming apparatus of claim 1, wherein a position of the pre-hemming punch is finely adjustable in three directions on the pre-hemming body.

8. The pre-hemming apparatus of claim 1, wherein the pre-hemming punch is coupled to be separable from the pre-hemming body.

9. The pre-hemming apparatus of claim 1, further comprising:

a stopper which is installed to protrude downward from the pre-hemming body, and positioned to be caught by the main body to restrict a rotation range of the pre-hemming body.

* * * * *